US006112810A

United States Patent [19]

Bailey et al.

[11] Patent Number: 6,112,810

[45] Date of Patent: Sep. 5, 2000

[54] REMOTELY CONTROLLED ASSEMBLY FOR WELLBORE FLOW DIVERTER

[75] Inventors: Thomas F. Bailey; Marc D. Kuck, both of Houston, Tex.

[73] Assignee: Weatherford/Lamb, Inc., Houston, Tex.

[21] Appl. No.: 09/183,956

[22] Filed: Oct. 31, 1998

[51] Int. Cl.[7] ..... E21B 19/00; E21B 34/10

[52] U.S. Cl. ..... 166/95.1; 166/53; 166/374

[58] Field of Search ..... 166/95.1, 373, 166/374, 86.1, 88.1, 53

[56] References Cited

U.S. PATENT DOCUMENTS

| | | | |
|---|---|---|---|
| Re. 24,609 | 2/1959 | Johnson | 166/88.1 |
| 2,527,225 | 10/1950 | Langstaff et al. | 175/195 |
| 3,889,959 | 6/1975 | Persson | 277/324 |
| 3,934,887 | 1/1976 | Biffle | 166/84.3 |
| 4,285,406 | 8/1981 | Garrett et al. | 175/195 |
| 4,398,599 | 8/1983 | Murray | 166/84.3 |
| 4,416,340 | 11/1983 | Bailey | 175/195 |
| 4,444,401 | 4/1984 | Roche et al. | 277/327 |
| 4,546,828 | 10/1985 | Roche | 166/84.4 |
| 4,754,820 | 7/1988 | Watts et al. | 175/195 |
| 4,971,148 | 11/1990 | Roche et al. | 166/88.1 |
| 5,022,472 | 6/1991 | Bailey et al. | 175/195 |
| 5,178,215 | 1/1993 | Yenulis et al. | 166/95.1 |
| 5,322,137 | 6/1994 | Gonzales | 175/195 |
| 5,490,564 | 2/1996 | Schulz et al. | 166/374 |
| 5,775,427 | 7/1998 | Skeels et al. | 166/344 |
| 5,791,411 | 8/1998 | Ricalton et al. | 166/84.1 |
| 5,794,693 | 8/1998 | Wright et al. | 166/85.5 |
| 5,848,643 | 12/1998 | Carbaugh et al. | 166/85.4 |

OTHER PUBLICATIONS

Larkin WellHeads Catalog No. 66—77, Joy Petroleum Equipment, Jan. 1977.

Shaffer 94–95 Catalog, p. 2662, 1994.

Drilling & Production System Services, ABB Vetco Gray, p. 135, 1994.

*Primary Examiner*—David Bagnell
*Assistant Examiner*—Jennifer R Dougherty
*Attorney, Agent, or Firm*—Guy McClung

[57] ABSTRACT

A wellbore flow diverter has been invented that, in certain aspects, has a housing with a main bore therethrough for fluid flow and a diverter bore therethrough for diverted fluid flow, the diverter bore in fluid communication with the main bore, internal apparatus including a spindle with a portion thereof within the housing, the internal apparatus for selectively closing off the main bore, at least one securement apparatus for releasably holding the internal apparatus in the housing, and remote control system operatively interconnected with and for remotely controlling the at least one securement apparatus in the housing.

22 Claims, 9 Drawing Sheets

REMOTELY CONTROLLED ASSEMBLY FOR WELLBORE FLOW DIVERTER

BACKGROUND OF THE INVENTION

1. Field Of The Invention

This invention is directed to a control head flow diverter for a wellbore system and, in one particular aspect to a remotely controlled flow diverter whose interior apparatus is non-manually removable.

2. Description of Related Art

There are a variety of control head flow diverters in the prior art. FIG. 7 shows a typical prior art control head flow diverter F that is secured on top of a typical blow out preventer ("BOP") stack (not shown). The head F has inner mechanisms, structures and apparatus, including a rotatable spindle S whose top is connected to a kelly and whose bottom is connected to a metal ring M and a movable or collapsible seal R. Bearings B facilitate rotation of the spindle S. Bolts L and T releasably secure the internal apparatus including the spindle S to a main body A of the head F. Flow enters the head F from below through an opening O. In response to the pressure of this fluid, the seal R closes to stop flow through the top of the spindle S and flow is then diverted out an exit port E. To remove the internal apparatus from the head F, the bolts L which initially extend into a J slot on the spindle preventing its rotation are manually removed, freeing the spindle for rotation and removal. Bolts T secure various parts together. This requires personnel at the location of the head F which is usually beneath a floor of a drilling rig.

There has long been a need for an effective, efficient and easily removable control head flow diverter. There has long been a need, recognized by the present inventors, for such a control head that does not require the manual manipulation of bolts to remove the control head from a BOP stack. There has long been a need, recognized by the present inventors, for a remotely controlled and remotely removable control head flow diverter.

SUMMARY OF THE PRESENT INVENTION

The present invention, in certain embodiments, discloses a control head flow diverter with a main housing within which internal apparatus is releasably held by one or more remotely controlled mechanisms which do not require manual manipulation for release of the internal apparatus from the main housing; although such manual manipulation is possible. The internal apparatus includes a seal element (e.g., but not limited to an element like the element R in FIG. 7) for diverting flow from a typical exit up through a spindle of the internal apparatus to an alternate housing exit port.

In one aspect the internal apparatus of the flow diverter has a series of lugs that releasably enter slots in the main housing. To prevent movement of the internal apparatus to a position that allows it to be removed from a top opening of the main housing, one or more remotely controlled side cylinders mounted on the exterior of the main housing each has an end projectable into the housing and into a slot, thus preventing removal of the internal apparatus until the cylinder ends are retracted. The slot may be any desired shape and may, in one aspect, have a vertical portion and an inner communicating horizontal portion.

Upon selective retraction of the side cylinder ends, rotation of the internal apparatus is permitted to a position in which it is freed so the lugs may move upwardly in a vertical portion of the slot, and the internal apparatus may be lifted out from the main housing. One or more remotely controlled torque cylinders, in certain aspects of the invention, are on a mounting plate on which the internal apparatus is mounted and the torque cylinder(s) is/are selectively activated to rotate the internal apparatus, thereby positioning the lugs for upward vertical movement in the vertical slot portion. The or each torque cylinder, preferably, has a downwardly projecting portion that rides in a corresponding track on a plate on the main housing. When the internal apparatus is removed from the main housing, the plate with the torque cylinders remains on the main housing.

In certain aspects the side cylinder(s) and/or torque cylinder(s) are remotely controlled while in other aspects any of the cylinders may also be manually manipulated for selective removal of the internal apparatus up through the main housing.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. New, useful, unique, efficient, nonobvious devices and methods for control head flow diverters;

Such control head flow diverters that do not require manual manipulation by personnel for removal of internal apparatus;

Such control head flow diverters that provide remotely controlled removal and installation of internal flow diverter apparatus; and Methods for using such flow diverters.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
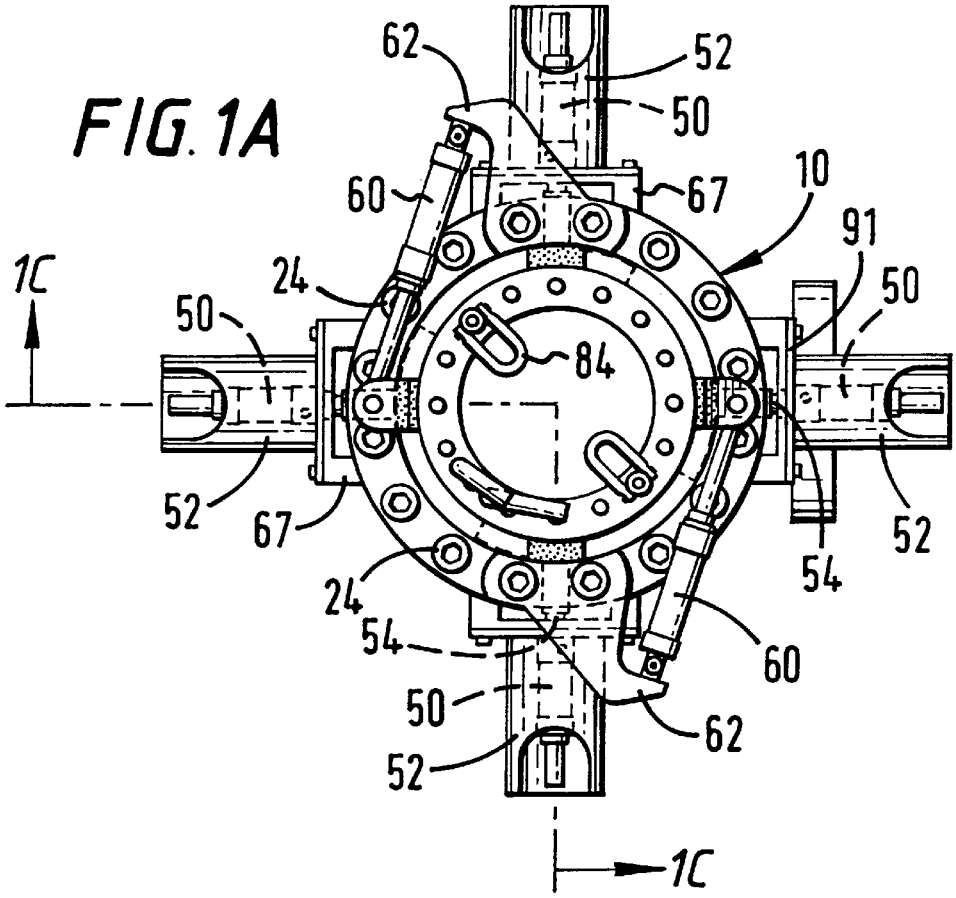
FIG. 1A and 1B are top views of a control head flow diverter according to the present invention.

FIGS. 1A–1F show a control head flow diverter ("head") 10 with a main housing 12 having a top opening 14, an interior 16, a side flow port 18, and a bottom opening 19.

Figure 7:
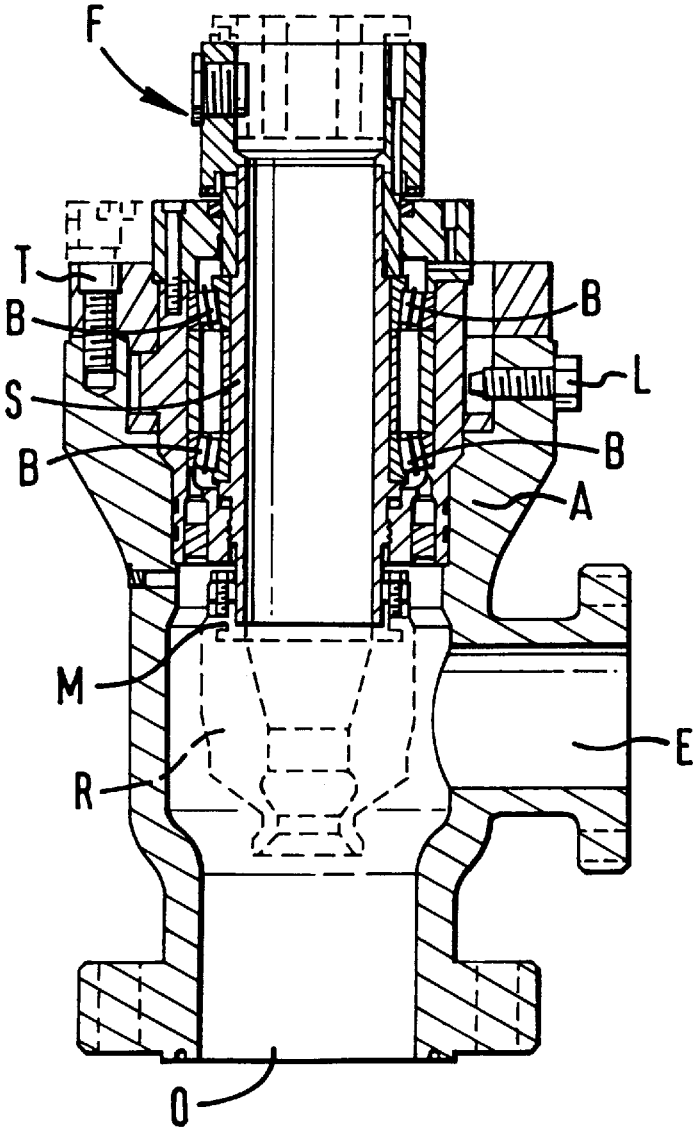
FIG. 7 Prior Art
FIG. 7 is a side cross-section view of a prior art control head flow diverter.

A lower plate 22 is secured above a plate 30 to the housing 12 with bolts 24. The plate 22 has tracks 28 formed therein. A mounting plate 32 is secured on the member 26 by bolts 24. Internal head apparatus 34 is secured to the mounting plate 32 and has a spindle 59 (like the spindle S, FIG. 7) and related structures 35 that extend down into the housing 12, including a hollow cylindrical memeber 26 on the plate 22. A seal element 90 is connected to the bottom of the spindle 59 (and may be any known suitable seal element, e.g. but not limited to, that of FIG. 7). Lugs 93 project out from the spindle 59 and are movable into and out of the slots 57.

Pins 36 extending through holes 38 in the plate 32 into corresponding holes 42 in the cylinders 60 to secure the plate 32 to the cylinders 60. Locking cylinders 50 in protective shrouds 52 are mounted on the sides of the housing 12. Rods 54 of the cylinders 50 project through the housing 12. As shown, the slots 57 have a vertical portion and a lower horizontal portion into which lugs 93 are movable.

Figure 1B:
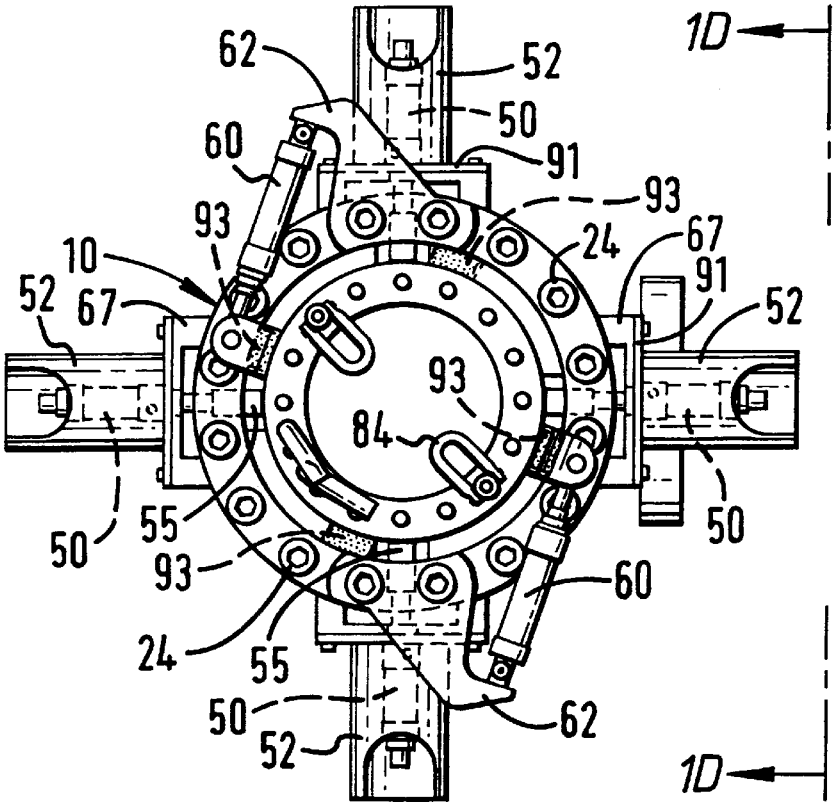
Figure 1C:
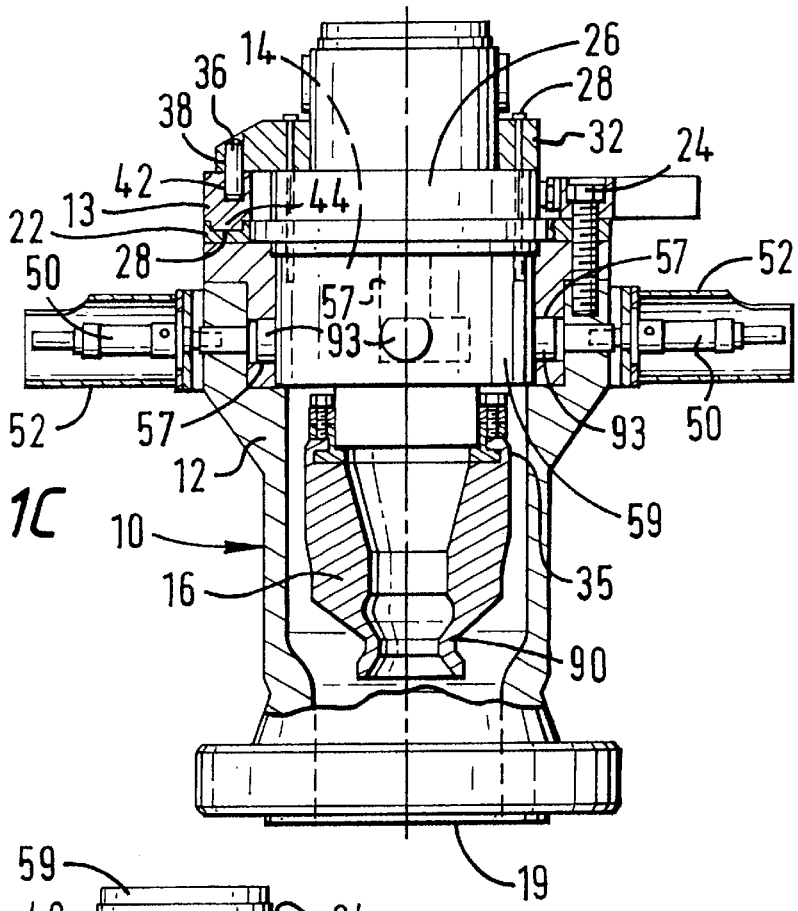
FIG. 1C is a view along line 1C—1C of FIG. 1A.
Figure 1D:
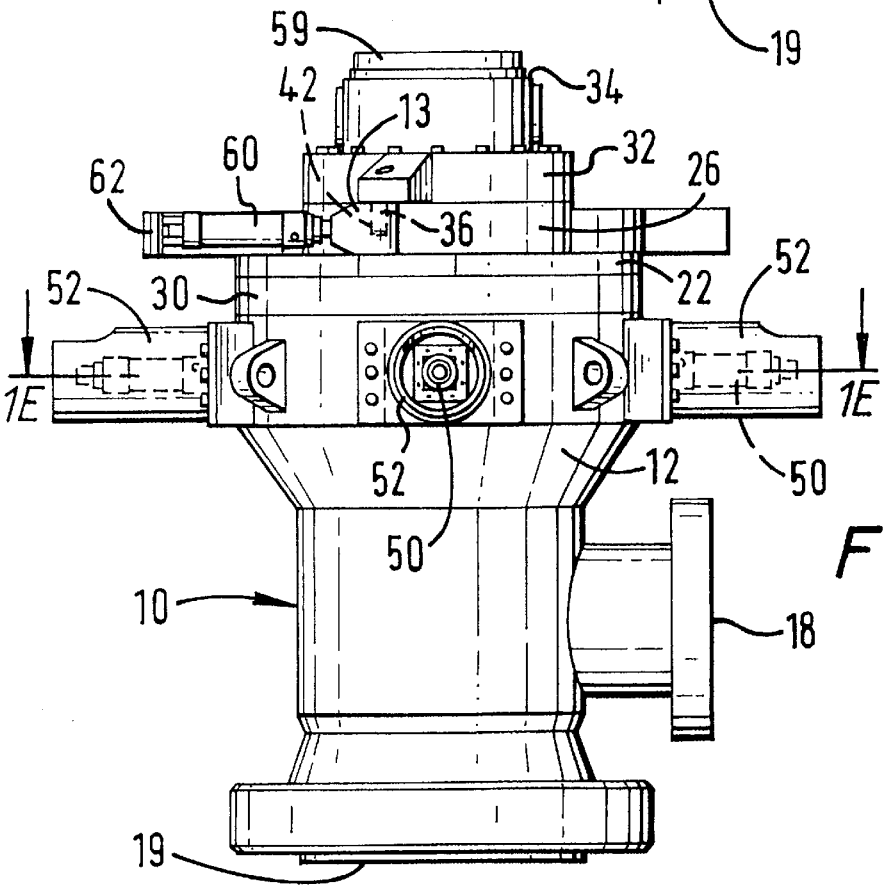
FIG. 1D is a view along line 1D—1D of FIG. 1B.
Figure 1E:
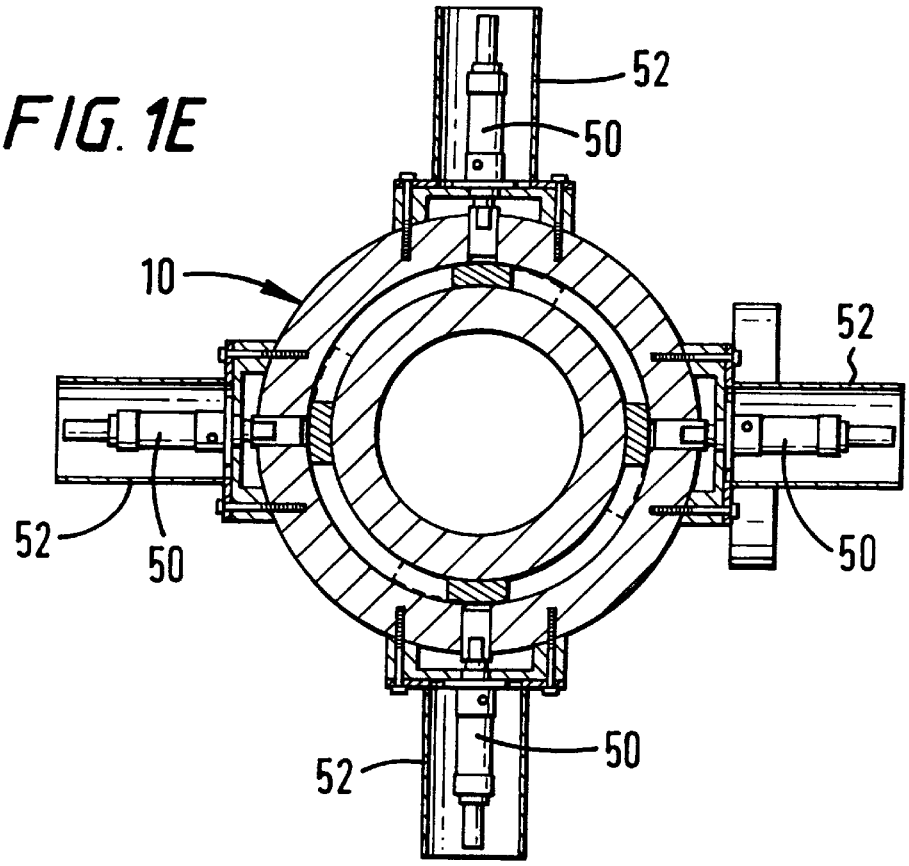
FIG. 1E and IF are cross-section views along lines 1E—1E of FIG. 1D.
Figure 1F:
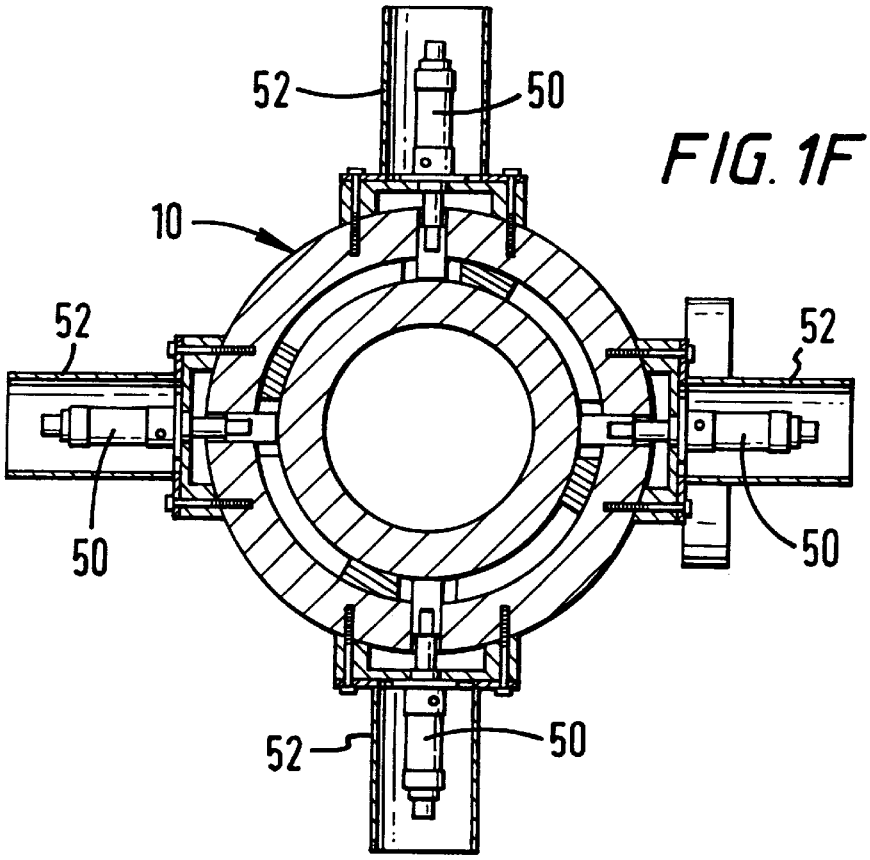
FIG. 1G shows partially an internal apparatus of the diverter of FIG. 1A.
FIG. 1H is a side view of a housing of the diverter of FIG. 1A.
Figure 1G:
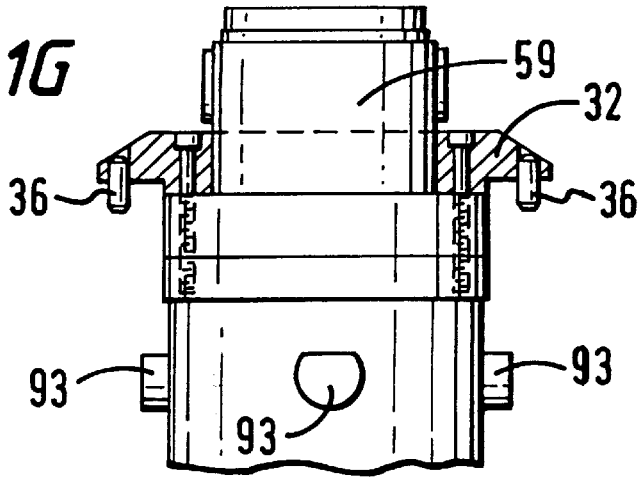
Figure 1H:
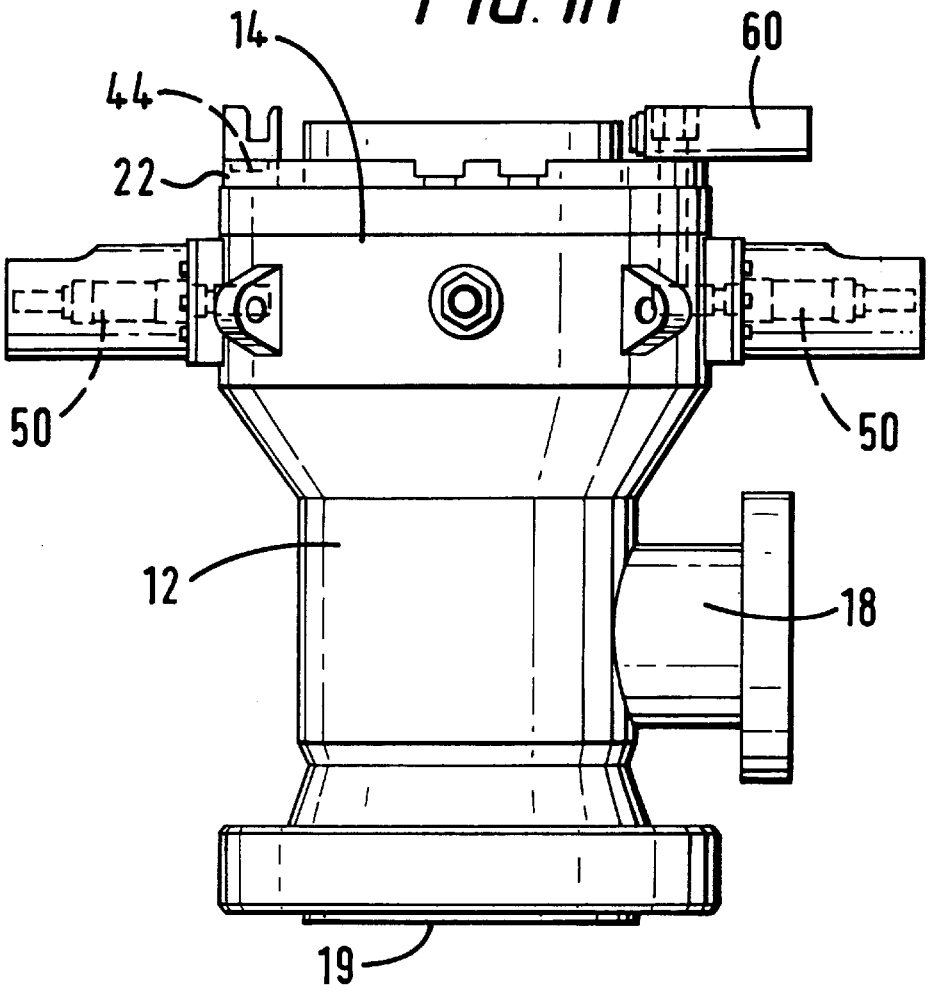
Figure 2A:
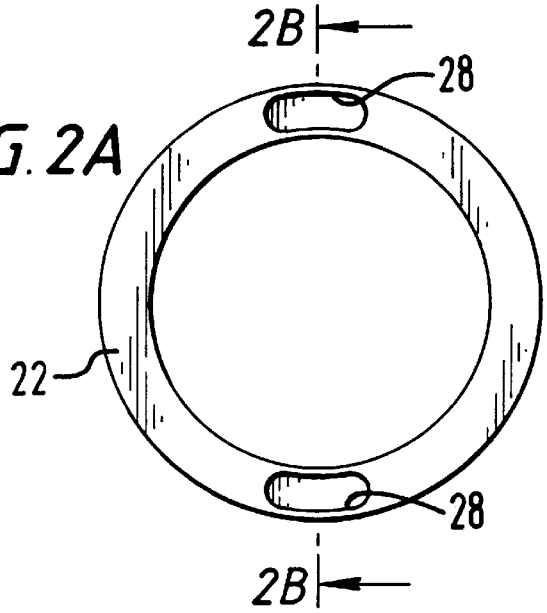
FIG. 2A is a top view of a plate of the head of FIG. 1A.
Figure 2B:
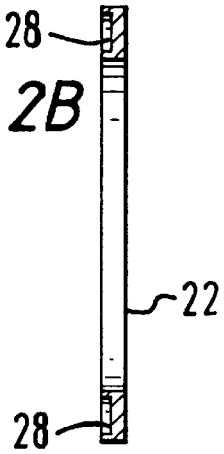
FIG. 2B is a view along lines 2B—2B of FIG. 2A.
Figure 3A:
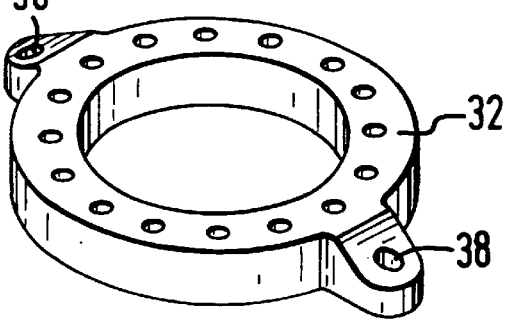
FIG. 3A is a perspective view of a mounting plate of the system of FIG. 1A.
Figure 3C:
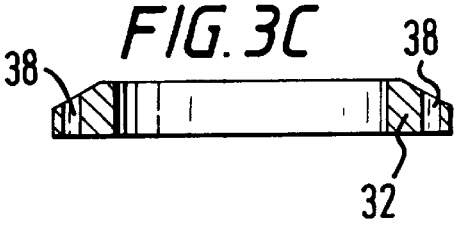
FIG. 3B is a top view and FIG. 3C is a side view of the plate of FIG. 3A.
Figure 3B:
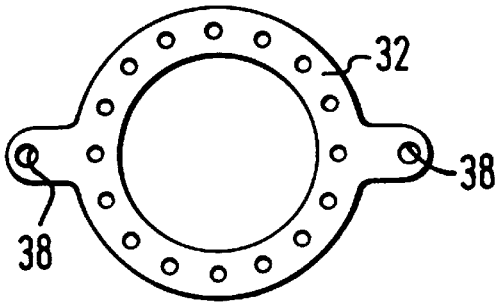
Figure 4:
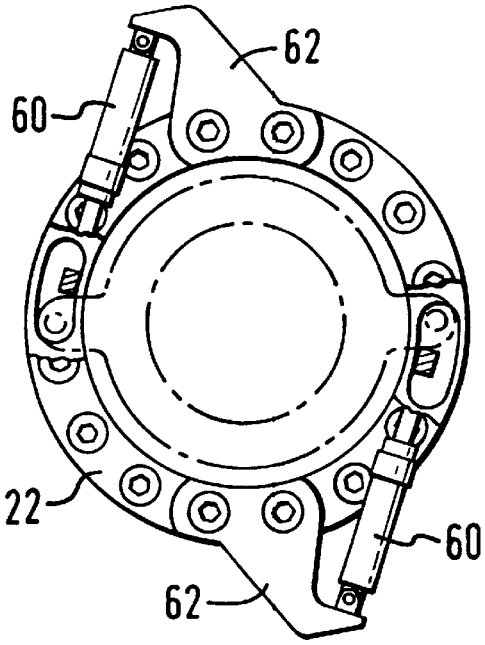
FIG. 4 is a top view of a plate of the system of FIG. 1C with brackets and torque cylinders attached.
Figure 5:
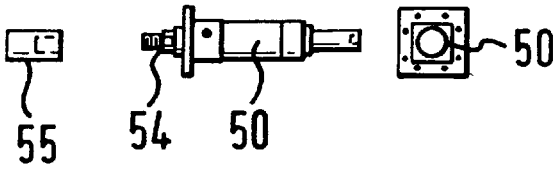
FIG. 5 is an exploded view of a torque cylinder as in FIG. 4 and its mounting hardware.
Figure 6A:
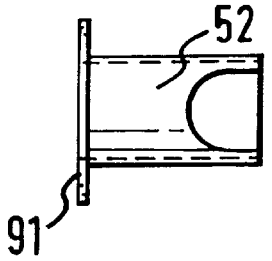
FIG. 6A is a side view of a side cylinder's housing as in FIG. 1C.

As shown in FIGS. 1A and 1B, torque cylinders 60 are movably mounted between brackets 62 which are secured to the plate 22 and the member 26 with the lower projections 44 of cylinder ends 13 movable in the tracks 28 of the plate 22.

Figure 6B:
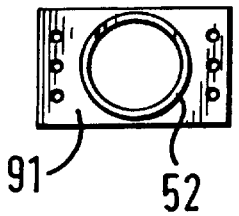
FIG. 6B is an end view of the housing of FIG. 6A.
Figure 6C:
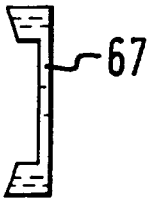
FIG. 6C is a top view of a mounting bracket for the housing of FIG. 6B.
Figure 6D:
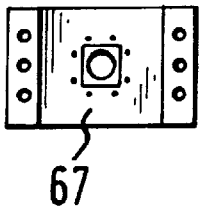
FIG. 6D is a front view of a plate used with the bracket of FIG. 6C.

FIG. 6C shows a mounting bracket 67 for the shrouds 52. FIG. 6D shows a plate 91 used with the bracket 67.

Figure 8:
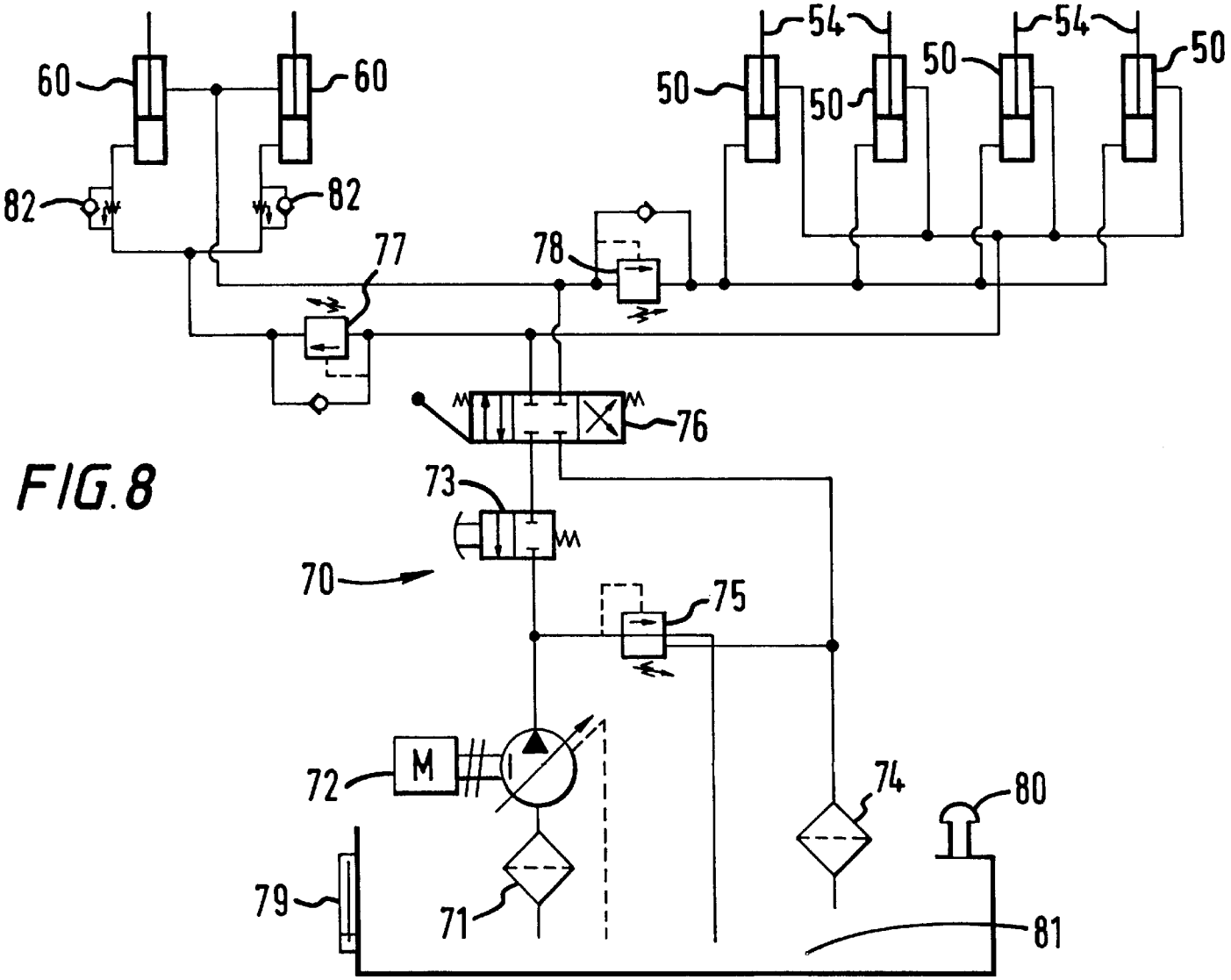
FIG. 8 is a schematic view of a control circuit for a system as in FIG. 1A.

FIG. 8 shows schematically a control system 70 for the side cylinders 50 and the torque cylinders 60 with a suction strainer 71, a pump/motor subsystem 72, a two-position safety valve 73, a return filter 74, a relief valve 75, a three position directional valve 76, sequence valves 77 and 78, a fluid level gauge 79, a vent 80, a fluid reservoir 81, and optional flow control valves 82 which maintain the same pressure in the torque cylinders so that they apply a balanced force. Known fluid flow lines and hoses are used between the various components of the system In one method of operation of an apparatus 10, controls, valves, and flow lines etc. of the system 70 are used. The pump/motor subsystem 72 provides and maintains pressurized hydraulic fluid pumped from the reservoir 81 to various flow lines and system components. The relief valve 75 is set at a suitable predetermined pressure. Initially the spindle and internal apparatus 34 is locked in place (as in FIG. 1F). To remove it from the main housing 12 (e.g. to "trip" out of the wellbore), the valves 73 and 76 are actuated (using, in one aspect, a control console CC remote from the system 10) so that pressurized hydraulic fluid flows to retract the ends 54 of the locking cylinders 50 (as in FIG. 1A). Fluid also flows to the valve 77 which prevents fluid, initially, from flowing to the torque cylinders 60. When fluid flow to the valve 77 reaches a predetermined pressure, pressurized fluid flows to the torque cylinders 60, extending them (as in FIG. 1A) and thereby rotating the mounting plate 32 and the internal apparatus 34 connected thereto to an unlocked position (as in FIG. 1E). The internal apparatus 34 can then be removed, e.g. with a line, drill string, or cable connected to lifting eyes 84. The pins 36 are not secured to the cylinder ends, but are movable in the holes therein and therefrom.

To reinstall internal apparatus 34, it is positioned above the main housing 12, the pins 36 are aligned with the holes 42 in the cylinder ends 13, and it is then moved down so that the pins 36 enter the holes 42 and the internal apparatus 34 then moves down within the main housing 12 of the flow diverter 10. Valves 73 and 76 are actuated and fluid flows to retract the cylinders 60 moving the apparatus 34 so that the ends 55 can be moved inwardly in the slots to block movement of the lugs 93. At this time fluid flows to the valve 78 which prevents the fluid from flowing to the locking cylinders 50 until a predetermined pressure. Then the locking cylinders 50 are actuated when sufficient fluid pressure is applied to and through the valve 78 to actuate the locking cylinders 50 and to thereby lock the internal apparatus 34 in place.

Figure 9A:
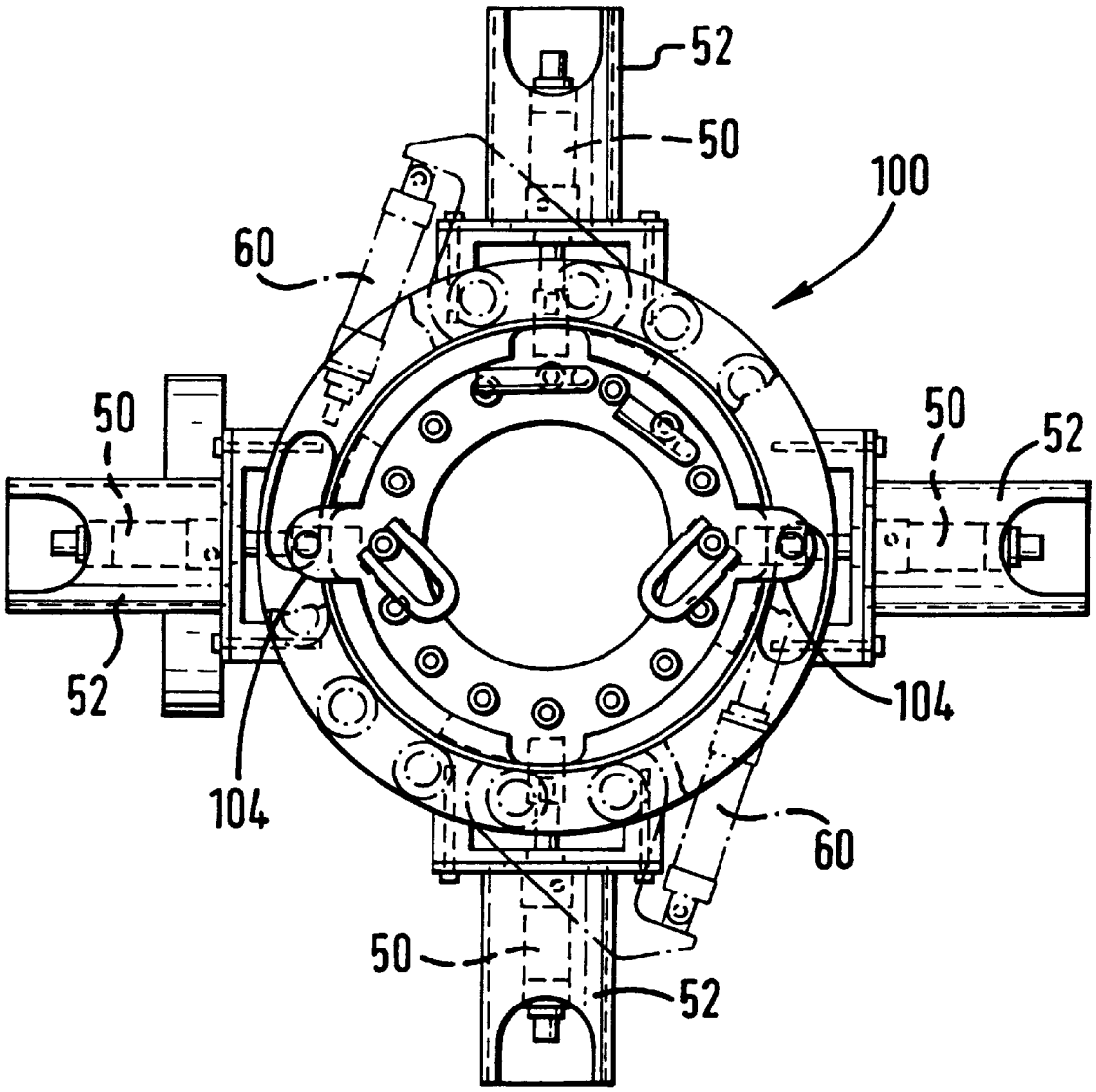
FIG. 9A is a top view of the apparatus of FIG. 9B.
Figure 9B:
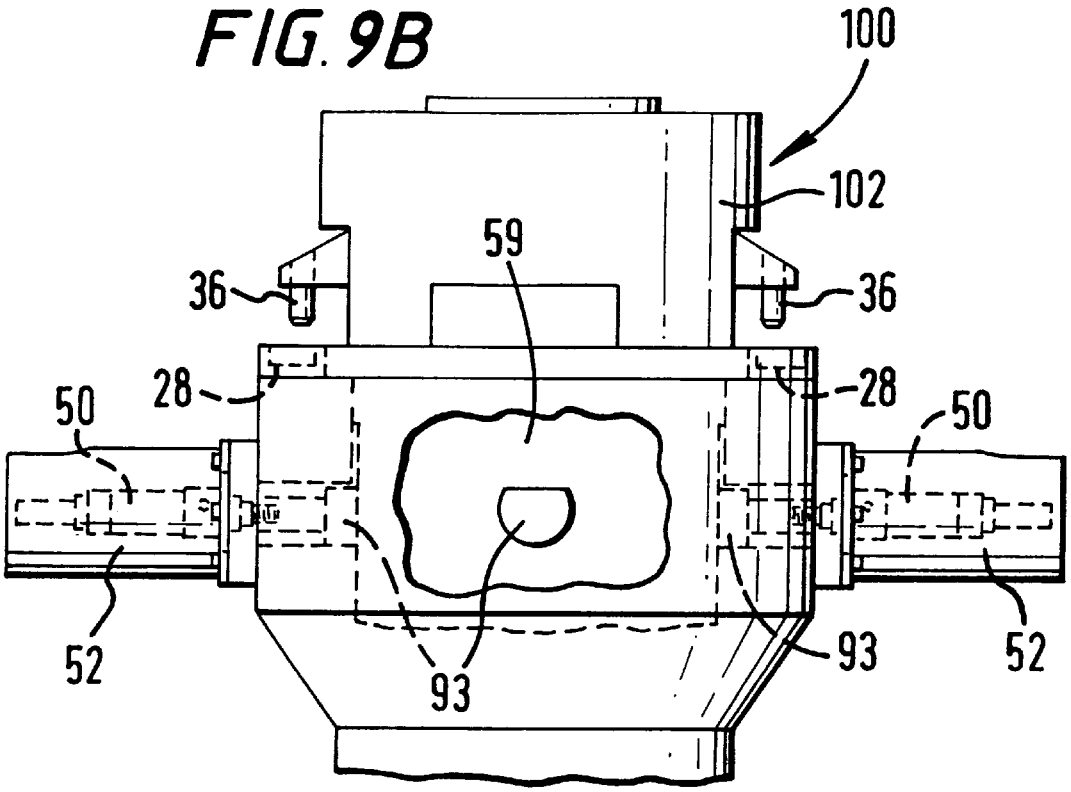
FIG. 9B is a side view of a flow diverter according to the present invention.
Figure 9C:
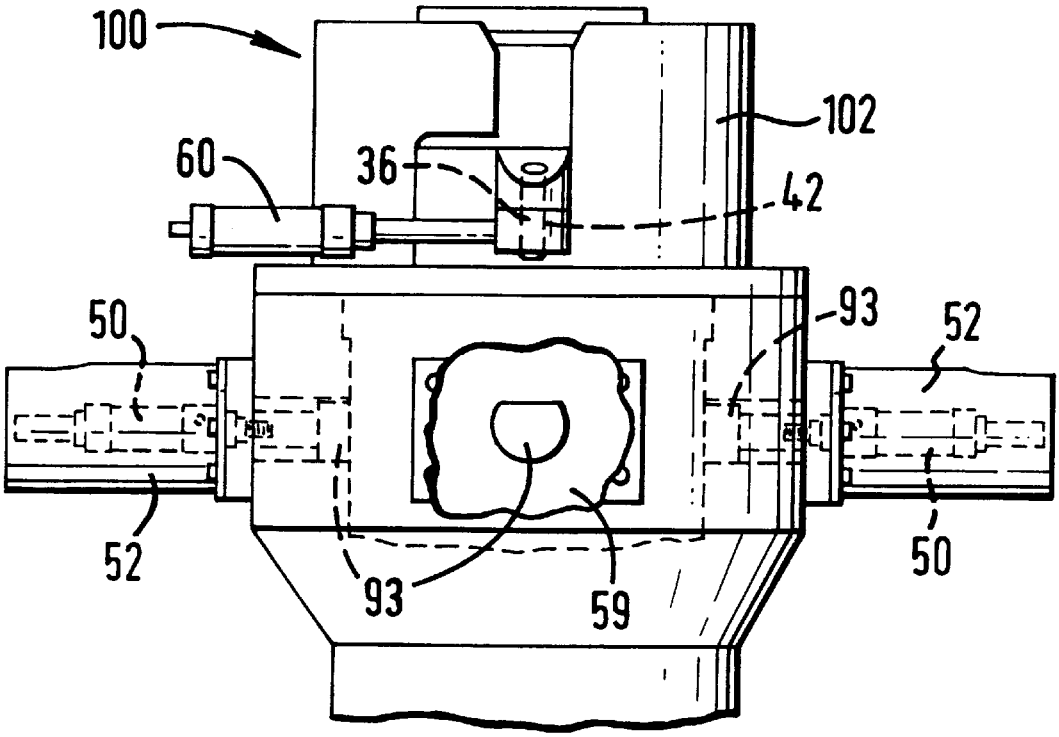
FIG. 9C is another side view of the diverter of FIG. 9B.

FIGS. 9A–9C show another embodiment of a system 100 according to the present invention which is like the system 10 (and the same numerals for the system 100 indicate the same parts as in the system 10), but with an entry guide 102 having slots 104 for guiding the pins 36 into the holes 42 in the cylinder ends 13.

The present invention therefore, in some but not necessarily all embodiments, provides a wellbore flow diverter with a housing with a main bore therethrough for fluid flow and a diverter bore therethrough for diverted fluid flow, the diverter bore in fluid communication with the main bore, internal apparatus including a spindle with a portion thereof within the housing, the internal apparatus for selectively closing off the main bore, at least one securement apparatus for releasably holding the internal apparatus in the housing, and remote control system operatively interconnected with and for remotely controlling the at least one securement apparatus in the housing. Such a diverter may have one, some, any combination of, or all of the following: additional manual manipulation apparatus for the at least one securement apparatus; wherein the internal apparatus is rotatable within the housing and the at least one securement apparatus includes at least one locking cylinder mounted on the housing and having a cylinder rod end movable within the housing to block rotation of the internal apparatus therein; wherein the at least one locking cylinder is a plurality of spaced apart locking cylinders; wherein the internal apparatus is rotatable within the housing and the at least one securement apparatus includes at least one torque cylinder mounted at one end to mounting apparatus interconnected with the housing, the at least one securement apparatus for rotating the internal apparatus to free the internal apparatus for removal from the housing; wherein the at least one torque cylinder is a plurality of spaced-apart torque cylinders; wherein the internal apparatus is rotatable within the housing to secure it therein against rotation and the at least one securement apparatus includes first apparatus for selectively preventing rotation of the internal apparatus within the housing and second apparatus for selectively rotating the internal apparatus to free the internal apparatus for removal from the housing, and the remote control system includes sequencing apparatus for selective actuation of the first apparatus and the second apparatus; wherein the at least one torque cylinder is a plurality of torque cylinders each with a torque cylinder end, each torque cylinder end having a hole therein with an opening on top of the torque cylinder end, the internal apparatus including a mount plate with pins, one pin for removable entry into a hole in torque cylinder end; wherein each of the torque cylinder ends has a lower projection, and the housing has for each torque cylinder end a track in which a lower projection of a torque cylinder end is releasably movable; and/or wherein the at least one securement apparatus includes at least one lug projecting out from the internal apparatus and at least one slot in the housing' interior into which and from which the at least one lug is movable.

The present invention discloses a wellbore flow diverter with a housing with a main bore therethrough for fluid flow and a diverter bore therethrough for diverted fluid flow, the diverter bore in fluid communication with the main bore, internal apparatus including a spindle with a portion thereof within the housing for selectively closing off main bore, the internal apparatus rotatable within the housing to a position at which it is secured therein against rotation, at least one securement apparatus for releasably holding the internal apparatus in the housing, and remote control system interconnected with and for remotely controlling the at least one securement apparatus in the housing, the at least one securement apparatus including a plurality of spaced apart locking cylinders, each mounted on the housing and having a cylinder rod end movable within the housing to block rotation of the internal apparatus therein, and the at least one securement apparatus including a plurality of spaced-apart torque cylinders, each mounted at one end to mounting apparatus interconnected with the housing for rotating the internal apparatus to free the internal apparatus for removal from the housing.

The present invention discloses in some, but not necessarily all, embodiments, a method for handling internal apparatus of a wellbore flow diverter, the wellbore flow diverter comprising a housing with a main bore therethrough for fluid flow and a diverter bore therethrough for diverted fluid flow, the diverter bore in fluid communication with the main bore, internal apparatus including a spindle with a portion thereof within the housing, the internal apparatus for selectively closing off the main bore, at least one securement apparatus for releasably holding the internal apparatus in the housing, and remote control system operatively interconnected with and for remotely controlling the at least one securement apparatus in the housing, the method comprising releasably holding the internal apparatus within the housing with the at least one securement apparatus. Such a method may include one, some, any combination of, or all of the following: remotely controlling the at least one securement apparatus to unlock the internal apparatus from the housing; wherein the internal apparatus is rotatable within the housing to a position at which it is securable therein against rotation and the at least one securement apparatus includes at least one locking cylinder mounted on the housing and having a cylinder rod end movable within the housing to block rotation of the internal apparatus therein, the method further including blocking rotation of the internal apparatus with the cylinder rod end of the at least one locking cylinder; wherein the internal apparatus is rotatable within the housing to a position at which it is securable therein against rotation and the at least one securement apparatus includes at least one torque cylinder mounted at one end to mounting apparatus interconnected with the housing for rotating the internal apparatus to a position at which it is liftable from the housing, the method including rotating the internal apparatus with the at least one torque cylinder; wherein the internal apparatus is rotatable within the housing to a position at which it is securable therein against rotation and the at least one securement apparatus includes first apparatus for selectively preventing rotation of the internal apparatus within the housing and second apparatus for selectively rotating the internal apparatus to free the internal apparatus for removal from the housing, and the remote control system includes sequencing apparatus for selective actuation of the first apparatus and the second apparatus, the method inlcuding selectively operating the first apparatus and the second apparatus in sequence; the mehtod including removing the internal apparatus from the housing; the method inclduing, following removal of the internal apparatus from the housing, installing the internal apparatus within the housing and remotely actuating the at least one securement apparatus to releasably hold the at least one securement apparatus within the housing; the method wherein the at least one locking cylinder is a plurality of spaced apart locking cylinders and wherein the at least one torque cylinder is a plurality of spaced-apart torque cylinders; wherein the internal apparatus includes a mount plate with downwardly projecting pins and each torque cylinder end has a hole corresponding to one of the pins, and the method including selectively moving the pins into and out of the holes; and/or wherein the housing has a track for a lower projection of each torque cylinder end, the method including movably positioning each torque cylinder end lower projection in a track.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A wellbore flow diverter comprising:

a housing with a main bore therethrough for fluid flow and a diverter bore therethrough for diverted fluid flow, the diverter bore in fluid communication with the main bore, internal apparatus including a spindle with a portion thereof within the internal apparatus for selectively closing off the main bore, at least one securement apparatus for releasably holding the internal apparatus in the housing, remote control system operatively interconnected with and for remotely controlling the at least one securement apparatus in the housing, the internal apparatus rotatable within the housing, and the at least one securement apparatus including at least one torque cylinder mounted at one end to mounting apparatus interconnected with the housing, the at least one securement apparatus for rotating the internal apparatus to free the internal apparatus for removal from the housing.

2. The wellbore flow diverter of claim 1 wherein the internal apparatus is rotatable within the housing and the at least one securement apparatus includes at least one locking cylinder mounted on the housing and having a cylinder rod end movable within the housing to block rotation of the internal apparatus therein.

3. The wellbore flow diverter of claim 2 wherein the at least one locking cylinder is a plurality of spaced apart locking cylinders.

4. The wellbore flow diverter of claim 1 wherein the at least one torque cylinder is a plurality of spaced-apart torque cylinders.

5. The wellbore flow diverter of claim 1 wherein the at least one torque cylinder is a plurality of torque cylinders each with a torque cylinder end, each torque cylinder end having a hole therein with an opening on top of the torque cylinder end, the internal apparatus including a mount plate with pins, one pin for removable entry into a hole in torque cylinder end.

6. The wellbore flow diverter of claim 5 wherein each of the torque cylinder ends has a lower projection, and the housing has for each torque cylinder end a track in which a lower projection of a torque cylinder end is releasably movable.

7. The wellbore flow diverter of claim 1 wherein the at least one securement apparatus includes at least one lug projecting out from the internal apparatus and at least one slot in the housing' interior into which and from which the at least one lug is movable.

8. A wellbore flow diverter comprising:

a housing with a main bore therethrough for fluid flow and a diverter bore therethrough for diverted fluid flow, the diverter bore in fluid communication with the main bore, internal apparatus including a spindle with a portion thereof within the housing, the internal apparatus for selectively closing off the main bore, at least one securement apparatus for releasably holding the internal apparatus in the housing, remote control system operatively interconnected with and for remotely controlling the at least one securement apparatus in the housing, the internal apparatus rotatable within the housing to secure it therein against rotation and the at least one securement apparatus includes first apparatus for selectively preventing rotation of the internal apparatus within the housing and second apparatus for selectively rotating the internal apparatus to free the internal apparatus for removal from the housing, and the remote control system includes sequencing apparatus for selective actuation of the first apparatus and the second apparatus.

9. The wellbore flow diverter of claim 8 wherein the internal apparatus is rotatable within the housing and the at least one securement apparatus includes at least one locking cylinder mounted on the housing and having a cylinder rod end movable within the housing to block rotation of the internal apparatus therein.

10. The wellbore flow diverter of claim 9 wherein the at least one locking cylinder is a plurality of spaced apart locking cylinders.

11. The wellbore flow diverter of claim 8 wherein the internal apparatus is rotatable within the housing and the at least one securement apparatus includes at least one torque cylinder mounted at one end to mounting apparatus interconnected with the housing, the at least one securement apparatus for rotating the internal apparatus to free the internal apparatus for removal from the housing.

12. The wellbore flow diverter of claim 11 wherein the at least one torque cylinder is a plurality of spaced-apart torque cylinders.

13. A wellbore flow diverter assembly comprising:

a housing with a main bore therethrough for fluid flow and a diverter bore therethrough for diverted fluid flow, the diverter bore in fluid communication with the main bore, internal apparatus including a spindle with a portion thereof within the housing for selectively closing off main bore, the internal apparatus rotatable within the housing to a position at which it is secured therein against rotation, at least one securement apparatus for releasably holding the internal apparatus in the housing, and remote control system interconnected with and for remotely controlling the at least one securement apparatus in the housing, the at least one securement apparatus including a plurality of spaced apart locking cylinders, each mounted on the housing and having a cylinder rod end movable within the housing to block rotation of the internal apparatus therein, and the at least one securement apparatus including a plurality of spaced-apart torque cylinders, each mounted at one end to mounting apparatus interconnected with the housing for rotating the internal apparatus to free the internal apparatus for removal from the housing.

14. A method for handling internal apparatus of a wellbore flow diverter, the wellbore flow diverted comprising a housing with a main bore therethrough for fluid flow and a diverter bore therethrough for diverted fluid flow, the diverter bore in fluid communication with the main bore, internal apparatus including a spindle with a portion thereof within the housing, the internal apparatus for selectively closing off the main bore, at least on securement apparatus for releasably holding the internal apparatus in the housing, and remote control system operatively interconnected with and for remotely controlling the at least on securement apparatus in the housing, the method comprising releasably holding the internal apparatus within the housing with the at least one securement apparatus wherein the internal apparatus is rotatable within the housing to a position at which it is securable therein against rotation and the at least one securement apparatus includes at least one torque cylinder mounted at one end to mounting apparatus interconnected with the housing for rotating the internal apparatus to a position at which it is liftable from the housing, the method further comprising rotating the internal apparatus with the at least on torque cylinder.

15. The method of claim 14 further comprising remotely controlling the at least one securement apparatus to unlock the internal apparatus from the housing.

16. The method of claim 15 further comprising:

removing the internal apparatus from the housing.

17. The method of claim 16 further comprising following removal of the internal apparatus from the housing, installing the internal apparatus within the housing and remotely actuating the at least one securement apparatus to releasably hold the at least one securement apparatus within the housing.

18. The method of claim 14 wherein the internal apparatus is rotatable within the housing to a position at which it is securable therein against rotation and the at least one securement apparatus includes at least one locking cylinder mounted on the housing and having a cylinder rod end movable within the housing to block rotation of the internal apparatus therein, the method further comprising:

blocking rotation of the internal apparatus with the cylinder rod end of the at least one locking cylinder.

19. The method of claim 14 wherein the internal apparatus is rotatable within the housing to a position at which it is securable therein against rotation and the at least one securement apparatus includes first apparatus for selectively preventing rotation of the internal apparatus within the housing and second apparatus for selectively rotating the internal apparatus to free the internal apparatus for removal from the housing, and the remote control system includes sequencing apparatus for selective actuation of the first apparatus and the second apparatus, the method further comprising:

selectively operating the first apparatus and the second apparatus in sequence.

20. The method of claim 14 wherein the internal apparatus is rotatable within the housing and the at least one securement apparatus includes at least one locking cylinder mounted on the housing and having a cylinder rod end movable within the housing to block rotation of the internal apparatus therein and the at least one locking cylinder is a plurality of spaced apart locking cylinders and wherein the at least one torque cylinder is a plurality of spaced-apart torque cylinders.

21. The method of claim 20 wherein the internal apparatus includes a mount plate with downwardly projecting pins and each torque cylinder has an end with a hole corresponding to one of the pins, and the method further comprising:

selectively moving the pins into and out of the holes.

22. The method of claim 21 wherein the housing has a track for a lower projection of each torque cylinder end, the method further comprising movably positioning each torque cylinder end lower projection in a track.

* * * * *